US007753175B2

(12) United States Patent
Fanion et al.

(10) Patent No.: US 7,753,175 B2
(45) Date of Patent: Jul. 13, 2010

(54) ELEVATOR CAR HAVING AN ANGLED UNDERSLUNG ROPING ARRANGEMENT

(75) Inventors: Loren Fanion, Bristol, CT (US); John Ferrisi, Southington, CT (US); Kevin Gleason, Burlington, CT (US); Daniel Greer, Bristol, CT (US); Robert Hammell, Killingworth, CT (US); Dave Jarvis, West Hartford, CT (US); John Kriss, East Hampton, CT (US); John Milton-Benoit, West Suffield, CT (US); Harry Terry, Avon, CT (US); Boris Traktovenko, Avon, CT (US); Ken Woronoff, Portland, CT (US)

(73) Assignee: Otis Elevator Company, Farmington, CT (US)

( * ) Notice: Subject to any disclaimer, the term of this patent is extended or adjusted under 35 U.S.C. 154(b) by 35 days.

(21) Appl. No.: 11/816,314

(22) PCT Filed: Feb. 25, 2005

(86) PCT No.: PCT/US2005/006261

§ 371 (c)(1),
(2), (4) Date: Aug. 15, 2007

(87) PCT Pub. No.: WO2006/093485

PCT Pub. Date: Sep. 8, 2006

(65) Prior Publication Data

US 2008/0164103 A1 Jul. 10, 2008

(51) Int. Cl.
*B66B 11/08* (2006.01)
*B66B 11/02* (2006.01)
*B66B 9/02* (2006.01)

(52) U.S. Cl. ..... 187/266; 187/250; 187/251; 187/401

(58) Field of Classification Search ..... 180/256, 180/262, 266, 249, 250–252, 254, 257, 401
See application file for complete search history.

(56) References Cited

U.S. PATENT DOCUMENTS 304,823 A * 9/1884 Hutchinson ..... 187/253

(Continued)

FOREIGN PATENT DOCUMENTS

EP 1371596 A1 12/2003

(Continued)

OTHER PUBLICATIONS

International Serarch Report and Written Opinion of the International Searching Authority for International application No. PCT/US05/06261 mailed Apr. 24, 2006.

(Continued)

*Primary Examiner*—John Q Nguyen
*Assistant Examiner*—Stefan Kruer
(74) *Attorney, Agent, or Firm*—Carlson, Gaskey & Olds PC

(57) ABSTRACT

An elevator system (20) includes an underslung car (22). A plurality of load bearing members (32-38) are closer together behind the elevator car and spaced farther apart near a front of the elevator car (22). A plurality of sheaves (40-44) are supported for vertical movement with the car and rotational movement relative to the car (22) such that the load bearing members (32-38) can be arranged in a 2:1 roping ratio and extend underneath the car (22). A disclosed example includes sheaves (40-44) rotatable about sheave axes that are at oblique angles relative to corresponding edges of the elevator car (22).

10 Claims, 2 Drawing Sheets

U.S. PATENT DOCUMENTS

| | | | | |
|---|---|---|---|---|
| 0,849,840 | A | 4/1907 | Foster | |
| 849,840 | A * | 4/1907 | Foster | 187/249 |
| 0,974,439 | A | 11/1910 | Schwab | |
| 1,027,628 | A | 5/1912 | Schwab | |
| 1,805,227 | A | 5/1931 | Rugg | |
| 1,896,776 | A | 2/1933 | James | |
| 1,896,777 | A | 2/1933 | James | |
| 5,663,538 | A | 9/1997 | Sakita | |
| 5,699,879 | A | 12/1997 | Sakita | |
| 5,865,274 | A | 2/1999 | Kiji et al. | |
| 5,877,462 | A | 3/1999 | Chenais | |
| 5,957,243 | A * | 9/1999 | Root et al. | 187/266 |
| 6,126,023 | A | 10/2000 | Durrant-Whyte et al. | |
| 6,273,217 | B1 | 8/2001 | Hikita | |
| 6,360,849 | B1 | 3/2002 | Hikita | |
| 6,364,065 | B1 | 4/2002 | Hikita | |
| 6,554,107 | B2 | 4/2003 | Yumura et al. | |
| 6,860,367 | B1 * | 3/2005 | Ericson | 187/265 |
| 7,032,716 | B2 | 4/2006 | Meyle et al. | |
| 7,117,979 | B2 | 10/2006 | Angst et al. | |
| 7,156,209 | B2 * | 1/2007 | Koeppe, Jr. | 187/266 |
| 7,178,635 | B2 | 2/2007 | Meissner et al. | |
| 7,296,661 | B1 * | 11/2007 | Petricio Yaksic | 187/266 |
| 2005/0082121 | A1 | 4/2005 | Deplazes | |
| 2005/0087402 | A1 | 4/2005 | Haegi et al. | |
| 2005/0279584 | A1 | 12/2005 | Reuter et al. | |
| 2006/0016641 | A1 * | 1/2006 | Koeppe | 187/250 |
| 2006/0163009 | A1 * | 7/2006 | Ishii et al. | 187/351 |
| 2006/0289240 | A1 | 12/2006 | Sakita | |
| 2007/0039785 | A1 | 2/2007 | Smith et al. | |

FOREIGN PATENT DOCUMENTS

| | | | |
|---|---|---|---|
| EP | 1698580 | A1 | 9/2006 |
| JP | 4345486 | | 12/1992 |
| JP | 4361960 | | 12/1992 |
| JP | 5051185 | | 3/1993 |
| JP | 5132257 | | 5/1993 |
| JP | 6305648 | | 11/1994 |
| JP | 8133611 | | 5/1995 |
| JP | 7157243 | | 6/1995 |
| JP | 7172716 | | 7/1995 |
| JP | 8133630 | | 5/1996 |
| JP | 9110316 | | 4/1997 |
| JP | 200344437 | | 12/2000 |
| JP | 2001226050 | | 8/2001 |
| JP | 2001240318 | | 9/2001 |
| JP | 2001247265 | | 9/2001 |
| JP | 2001251188 | | 9/2001 |
| JP | 2001335244 | | 12/2001 |
| JP | 2002220164 | | 8/2002 |
| JP | 2002255460 | | 9/2002 |
| JP | 2003160283 | | 6/2003 |
| JP | 2004155519 | | 6/2004 |

OTHER PUBLICATIONS

International Preliminary Report on Patentability for International application No. PCT/US05/06261 mailed Jan. 24, 2007.

* cited by examiner

ELEVATOR CAR HAVING AN ANGLED UNDERSLUNG ROPING ARRANGEMENT

FIELD OF THE INVENTION

This invention generally relates to elevator systems. More particularly, this invention relates to roping arrangements for supporting an elevator car.

DESCRIPTION OF THE RELATED ART

Elevator systems often use a traction drive arrangement for moving a car and counterweight within a hoistway. Load bearing members such as steel ropes or flat belts typically support the weight of the counterweight and the elevator car. A drive machine controls movement of at least one traction sheave, which moves the load bearing members and the car and counterweight in a known manner.

A variety of roping strategies for supporting cars and counterweights within a hoistway are known. With different elevator system configurations, different challenges are presented for achieving an effective roping configuration while accommodating the other components that typically are needed within a hoistway. In many instances, it is possible to use a 1:1 roping ratio and support opposite ends of the load bearing members on the top of the counterweight and car, respectively. Other configurations, present more design challenges.

Some system configurations are not suitable for a 1:1 roping arrangement. One example is a system having more than one elevator car within a single hoistway. Different roping and component arrangements are needed to accommodate more than one elevator car in a hoistway.

For some such situations it is desirable to have a 2:1 roping ratio. Underslung car roping arrangements have been proposed for such situations. One difficulty with known arrangements is that they introduce complexities for trying to accommodate other components within the hoistway. For example, the sides of an elevator car typically must accommodate guide rollers that follow the guide rails within the hoistway. Elevator governor ropes and governor components typically extend along the sides of the car within the hoistway. Positioning tapes and traveling cables for supplying power or communication signals typically also must be accommodated along the sides of an elevator car. Therefore, it is not usually possible to route load bearing members about the sides of an elevator car.

At the same time, however, arranging load beating members along the front of an elevator car typically interferes with door operation, or requires an unusual drive machine configuration. A typical elevator drive machine has a drive sheave that accommodates the load bearing members when they are relatively very close together. Such spacing between the load bearing members does not make it possible to maintain car balance and route the load bearing members about the front of an elevator car without potentially interfering with the operation of the door components or the clearance at the hoistway opening at a landing.

It is desirable to have the ability to incorporate a 2:1 roping ratio that does not require significant alteration of other elevator system components. This invention addresses that need.

SUMMARY OF THE INVENTION

An exemplary disclosed elevator car assembly includes an elevator car. A plurality of sheaves are supported for rotational movement relative to the car and for vertical movement with the car as the car moves within a hoistway, for example. At least a first one and a second one of the sheaves are positioned near one edge of the frame. At least a third one and a fourth one of the sheaves are positioned near an oppositely facing edge of the frame. The first sheave is laterally spaced a first distance from the second sheave. The third sheave is laterally spaced a second, greater distance from the fourth sheave.

In one example, the first and second sheaves rotate about axes that are aligned at an oblique angle relative to the one edge of the frame. In one example, the first sheave axis is traverse to the second sheave axis.

An exemplary disclosed elevator assembly includes an elevator car and a plurality of load bearing members that at least partially support the car. A plurality of sheaves are supported for vertical movement with the car. The sheaves guide the load bearing members under the car. The load bearing members are a first distance apart near a first side of the car and a second, further distance apart near a second, oppositely facing side of the car.

In one example, the load bearing members near the second side of the car extend along oppositely facing lateral sides of the car.

One example includes at least one door supported for lateral movement along the second side of the car within an operating range. The load bearing members along the second side of the car are outside of the operating range. The load bearing members along the first side of the car are close enough together to accommodate being driven by a conventional traction sheave without requiring modification to a drive machine.

The various features and advantages of this invention will become apparent to those skilled in the art from the following detailed description of a currently preferred embodiment. The drawings that accompany the detailed description can be briefly described as follows.

DETAILED DESCRIPTION OF THE PREFERRED EMBODIMENTS

Figure 1:
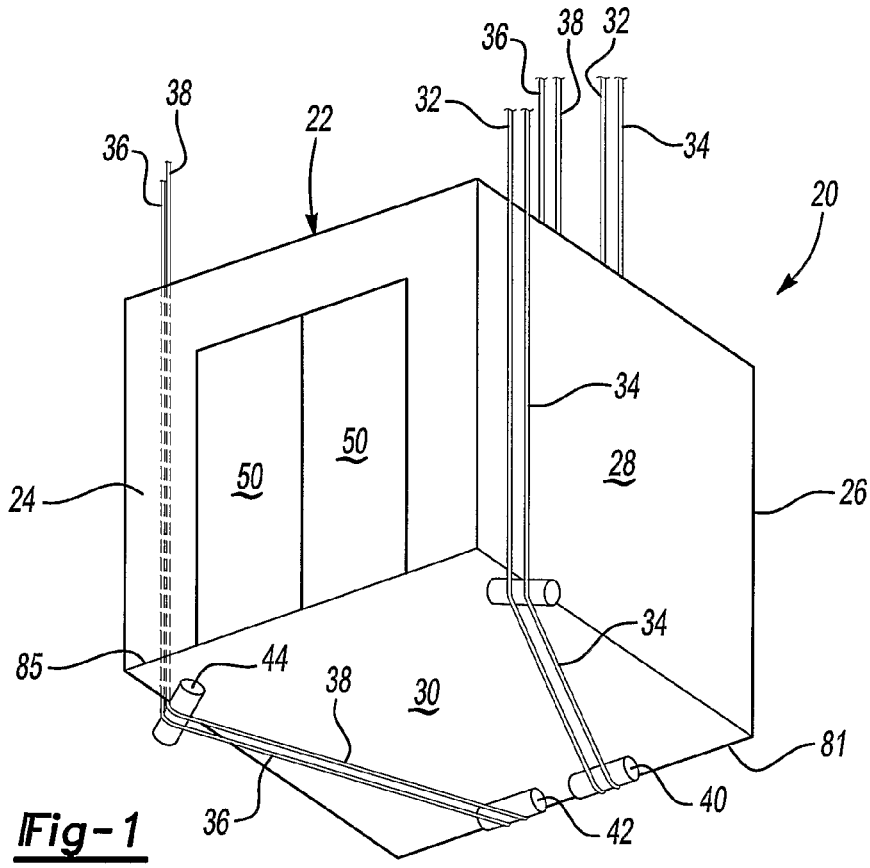
FIG. 1 is a perspective illustration schematically showing an example elevator car assembly designed according to one embodiment of this invention.

FIG. 1 schematically shows selected portions of an elevator system 20. An elevator car 22 includes a frame and cabin as known. The example car 22 has a front side 24, a back side 26 and lateral sides 28. A bottom of the car 30 is visible in the illustration of FIG. 1.

A plurality of load bearing members 32, 34, 36 and 38 at least partially support the car 22 and facilitate movement of the car in a known manner within a hoistway. The load bearing members 32-38 in one example comprise flat belts having at least one elongated tension member coated with a polymer jacket. In another example, the load bearing members comprise steel ropes. The disclosed example embodiments are useful with a variety of load bearing members.

Figure 1A:
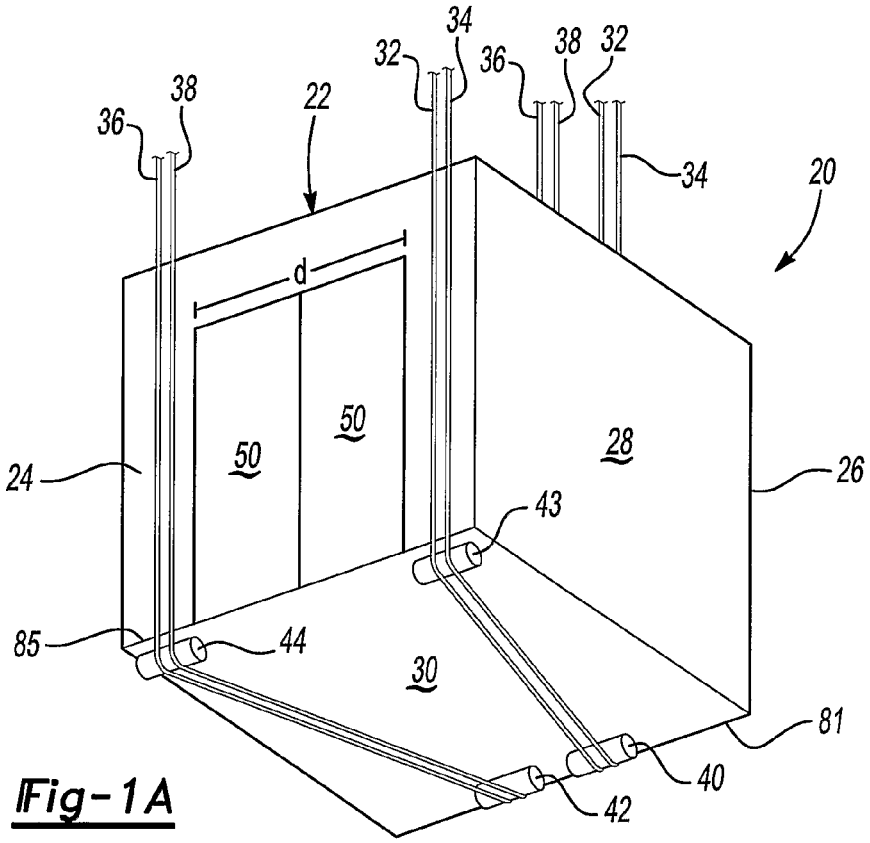
FIG. 1A shows another example similar to the embodiment of FIG. 1.

In the illustrated example of FIG. 1, the load bearing members 32 and 34 extend from above the car 22 down along the back side 26, then under the bottom 30 and upward along the lateral sides 28, respectively. In this example, the portions of the load bearing members 32-38 extending along the lateral sides 28 are behind the front side 24 of the car 22. In the example shown in FIG. 1A, the load bearing members 32-38 at least partially extend along the front side 24.

The load bearing members 32 and 34 are directed around a first sheave 40 while the load bearing members 36 and 38 are directed around a second sheave 42. The first sheave 40 and the second sheave 42 are positioned relatively close together and spaced apart by a first distance.

As can be appreciated from FIG. 1, the load bearing members 32 and 34 are also directed around a third sheave 43 while the load bearing members 36 and 38 are directed around a fourth sheave 44. The third sheave 43 and the fourth sheave 44 are spaced apart a second, greater distance compared to the first distance separating the first sheave 40 and the second sheave 42. The different distances between the different sheaves effectively divert the load bearing members in an angular direction underneath the elevator car 22. Such an arrangement provides several advantages.

One advantage to the disclosed example is that the load bearing members 32-38 can be kept spaced apart a distance that corresponds to a conventional traction sheave design. A machine supported near the top of a hoistway having a traction sheave that drives the load bearing members with the load bearing members relatively close together can be used while still achieving a 2:1 roping ratio and having the load bearing members extend along either the lateral sides 28 or the front side 24. Having the load bearing members spaced apart a second distance controlled by the spacing between the third sheave 43 and the fourth sheave 44 near the front side 24 of the car 22 allows for a much greater spacing between the load bearing members 32, 34 and 36, 38. Such greater spacing allows for the load bearing members to extend along the front side 24 of the elevator car 22 (in the example of FIG. 1A) without interfering with an operating range d of elevator car doors 50 and components associated with them.

Additionally, the disclosed example allows for arranging load bearing members in a 2:1 roping ratio with an underslung car that leaves at least most of the lateral sides 28 of the car unobstructed by the load bearing members to accommodate other necessary components within an elevator hoistway.

Figure 2:
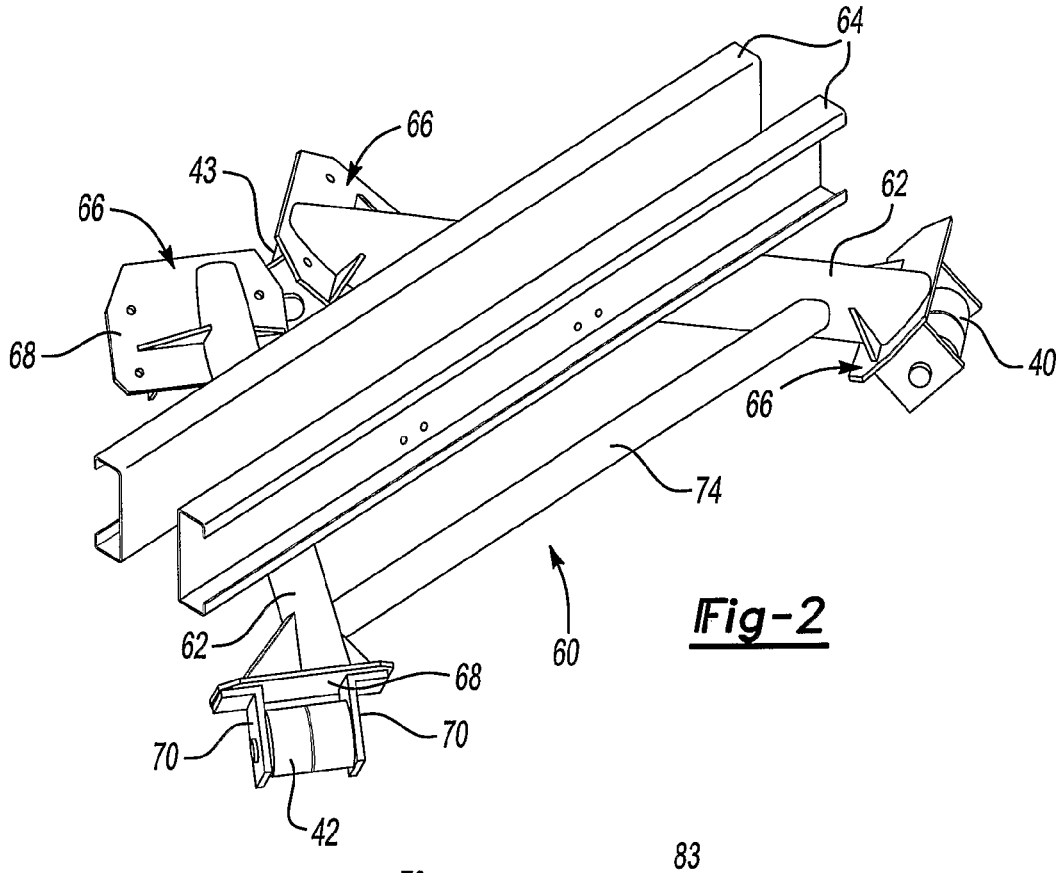
FIG. 2 is a diagrammatic, perspective illustration of an example device useful with an embodiment consistent with the example shown in FIG. 1.

One example support frame 60 for such an underslung arrangement is shown in FIG. 2. This example includes primary support members 62 that are secured to a plank beam 64 that extends along the bottom of a frame of the car 22 in a known manner. In one example, the primary support members 62 are secured to the plank beam 64 using bolts. Sheave supports 66 are provided at the opposite ends of the primary support members 62 in the illustrated example. Each sheave support 66 includes a plate 68 secured directly to the primary support member 62 and support arms 70 having an end extending away from the plate 68. In this example, each sheave is supported by two support arms 70. At least two stabilizing members 74 extend between the primary support member 62. In one example, the components of the support frame 60 comprise steel.

In one example, each primary support member 62 and the corresponding sheave supports 66 comprise a mounting bracket that may be positioned at a variety of angles relative to the plank beam 64. In such an example, each mounting bracket is separately positionable to provide a customizable arrangement of the path followed by the load bearing members underneath the elevator car.

Figure 3:
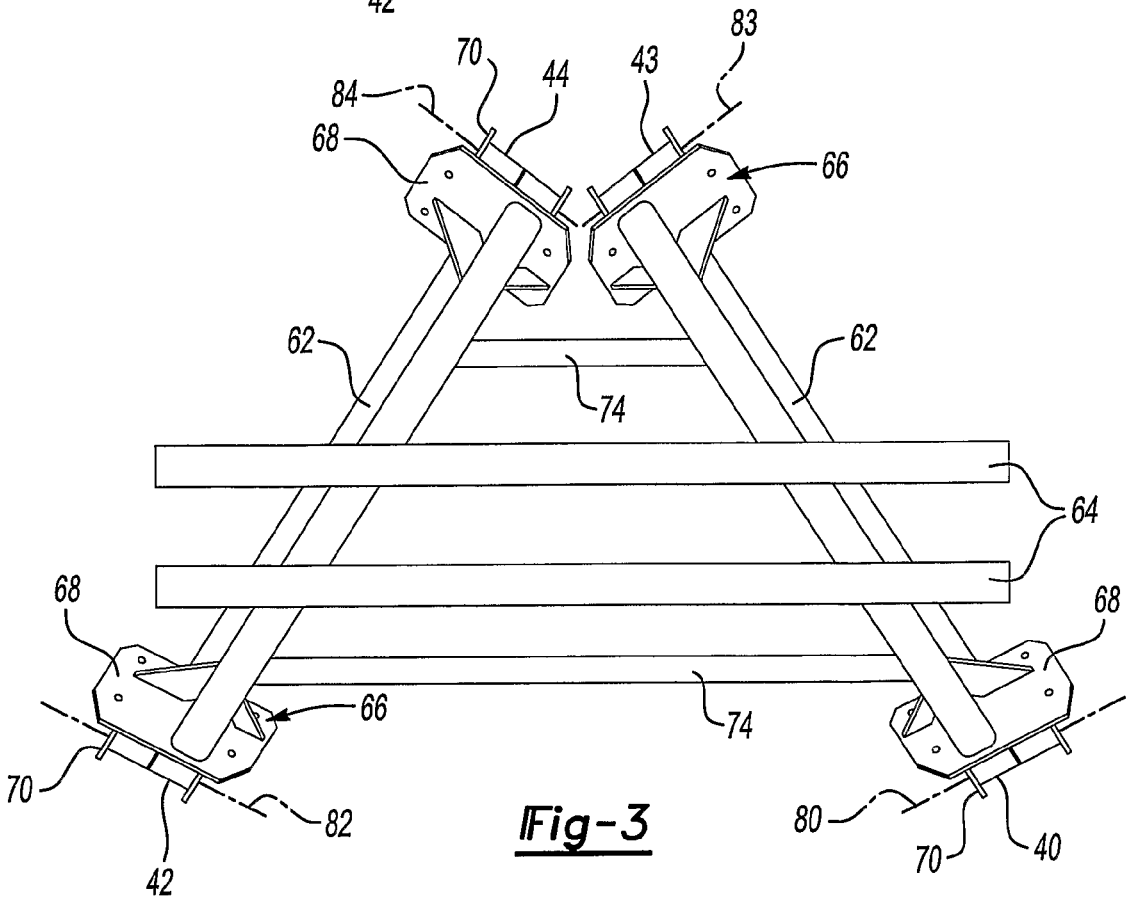
FIG. 3 is an elevational view as seen from the top of the illustration in FIG. 2.

FIG. 3 shows the embodiment of FIG. 2 from another perspective. As can be appreciated from FIG. 3, each of the sheaves 40-44 rotates about a sheave axis such that the sheave is rotatable relative to the elevator car 22. A first sheave axis 80 is aligned at an oblique angle relative to a first edge 81 of the car 22. In the illustrated example, the first edge 81 corresponds to the edge between the bottom 30 and the back side 26 of the car 22. A second sheave axis 82 is aligned at a similar oblique angle relative to the edge 81. In this example, the first sheave axis 80 is transverse to the second sheave axis 82.

Similarly, a third sheave axis 83 and a fourth sheave axis 84 are transverse to each other and aligned at an oblique angle relative to an oppositely facing edge 85 on the car 22.

As can be appreciated from FIG. 3, for example, positioning the support frame 60 allows for positioning the sheaves equally spaced from a center of a corresponding edge of the car 22.

As the support frame 60 is secured to the car frame, the sheaves 40-44 are supported for vertical movement with the car within a hoistway, for example.

The disclosed example provides an efficient way of providing a 2:1 roping arrangement with an underslung car in an efficient and cost-effective manner. Keeping the load bearing members closer together behind the car 22 and farther apart from each other in front of the car 22 allows for accommodating conventional elevator system components while still achieving the desired roping ratio and overall elevator system configuration.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator car assembly, comprising:

an elevator car;

a plurality of sheaves that are supported for rotational movement relative to the car and for vertical movement with the car, at least a first one and a second one of the sheaves at one edge of the car, at least a third one and a fourth one of the sheaves at an oppositely facing edge of the car, the first sheave being laterally spaced a first distance from the second sheave and the third sheave being laterally spaced a second, greater distance from the fourth sheave; and a mounting bracket secured to an underside of the car, the mounting bracket including at least one primary member extending generally perpendicular to an axis of the first sheave and having a length corresponding to a distance between the first sheave and the third sheave, the mounting bracket including a second primary member extending generally perpendicular to an axis of the second sheave and having a length corresponding to a distance between the second sheave and the fourth sheave, each of the primary members having support members at ends of the primary members, the support members supporting corresponding sheaves for rotation relative to the mounting bracket.

2. The assembly of claim 1, wherein the first and second sheaves rotate about respective axes that are aligned at an oblique angle relative to the one edge.

3. The assembly of claim 1, wherein the one edge is along a back of the car and the oppositely facing edge is along a front of the car.

4. The assembly of claim 1, wherein the first and second sheaves are on opposite sides of a center of the one edge and the third and fourth sheaves are on opposite sides of a center of the oppositely facing edge.

5. The assembly of claim 2, wherein the first sheave axis is aligned transverse to the second sheave axis.

6. The assembly of claim 2, wherein the third sheave rotates about an axis that is generally parallel to the first sheave axis and the fourth sheave rotates about an axis that is generally parallel to the second sheave axis.

7. The assembly of claim 3, including at least one door supported for lateral movement relative to the car and wherein the third and fourth sheaves are positioned laterally outside of an operating range of the door.

8. The assembly of claim 3, wherein the front of the car extends between two oppositely facing sides of the car and the third and fourth sheaves are positioned at least partially laterally apart further than the two oppositely facing sides of the car.

9. The assembly of claim 3, including a third distance between the back and the front of the car and wherein a fourth distance between the first sheave and the third sheave is less than the third distance.

10. The assembly of claim 4, wherein the first and second sheaves are equally spaced from the center of the one edge and the third and fourth sheaves are equally spaced from the center of the oppositely facing edge.

* * * * *